US007592758B2

(12) United States Patent
Chen

(10) Patent No.: US 7,592,758 B2
(45) Date of Patent: Sep. 22, 2009

(54) STABILIZER WITH BRIGHTNESS CONTROL FOR HIGH INTENSITY DISCHARGE LAMP

(76) Inventor: A-Chuan Chen, 4F., No. 18, Lane 83, Sec. 2, Zhong-Xing Rd., Wugu Village, Taipei County (TW)

( * ) Notice: Subject to any disclaimer, the term of this patent is extended or adjusted under 35 U.S.C. 154(b) by 145 days.

(21) Appl. No.: 11/898,531

(22) Filed: Sep. 13, 2007

(65) Prior Publication Data

US 2008/0191640 A1 Aug. 14, 2008

(30) Foreign Application Priority Data

Sep. 15, 2006 (TW) ..... 95216529 U

(51) Int. Cl.
*H01J 15/04* (2006.01)

(52) U.S. Cl. ..... 315/326; 315/291; 315/293; 439/76.1; 439/76.2

(58) Field of Classification Search ..... 315/32, 315/33, 56, 112, 115, 326, 291, 357
See application file for complete search history.

(56) References Cited

U.S. PATENT DOCUMENTS 6,967,288 B2 * 11/2005 Ohsawa et al. ..... 174/104
7,429,828 B2 * 9/2008 Cleland et al. ..... 315/157

* cited by examiner

*Primary Examiner*—Douglas W Owens
*Assistant Examiner*—Jianzi Chen
(74) *Attorney, Agent, or Firm*—Schmeiser, Olsen & Watts LLP

(57) ABSTRACT

A stabilizer with brightness control for a High Intensity discharge lamp comprising a base, an positive electrode terminal configured with a power input of the base, a negative electrode terminal configured with the base on the same side the positive electrode terminal configured, a power-switching terminal configured with the base on the other side the positive electrode terminal configured, a control switch and a control element on a circuit board inside the base, wherein the control switch coupled with the positive electrode terminal, the negative electrode terminal and the power-switching terminal respectively, and a connect pin of the power-switching terminal is corresponding to the control element on a circuit board inside the base so as to adjust brightness for a High Intensity discharge lamp by the control switch.

4 Claims, 6 Drawing Sheets

STABILIZER WITH BRIGHTNESS CONTROL FOR HIGH INTENSITY DISCHARGE LAMP

BACKGROUND OF THE PRESENT INVENTION

1. Field of Invention

The present invention relates to a stabilizer with brightness control for a High Intensity discharge lamp comprising a base, an positive electrode terminal configured with a power input of the base, a negative electrode terminal configured with the base on the same side the positive electrode terminal configured, a power-switching terminal configured with the base on the other side the positive electrode terminal configured, a control switch and a control element on a circuit board inside the base, wherein the control switch coupled with the positive electrode terminal, the negative electrode terminal and the power-switching terminal respectively, and a connect pin of the power-switching terminal is corresponding to the control element on a circuit board inside the base so as to adjust brightness for a High Intensity discharge lamp by the control switch.

2. Description of Related Arts

A conventional HID stabilizer illustrated in FIG. 1 and FIG. 2, which comprises a body A1, a plug A2, a pin A3 and a circuit board A4. The body further comprises an upper body A6 and a lower body A7, wherein the plug A2 is arranged in the upper body A6 and with dual sets of the pin A3. One of the pin A3 is positive electrode and the other one is negative electrode. In addition, the circuit board A4 is configured in the lower body A7, the circuit board A4 is capable of controlling power (watts) consumption so that a HID A5 is lightened by the stable watts through the circuit board A4. Therefore, when a user replaces the HID A5 as a new one with different watts, the stabilizer must be replaced together. In an obvious manner, it is a kind of resource waste and without convenience. It is valuable to research in diligence for resolving above disadvantages in view of the difficulty in this field.

SUMMARY OF THE PRESENT INVENTION

Whereas, the present invention is to provide a stabilizer with brightness control for a High Intensity discharge lamp comprising a base, an positive electrode terminal configured with a power input of the base, a negative electrode terminal configured with the base on the same side the positive electrode terminal configured, a power-switching terminal configured with the base on the other side the positive electrode terminal configured, a control switch and a control element on a circuit board inside the base, wherein the control switch coupled with the positive electrode terminal, the negative electrode terminal and the power-switching terminal respectively, and a connect pin of the power-switching terminal is corresponding to the control element on a circuit board inside the base so as to adjust brightness for a High Intensity discharge lamp by the control switch.

One or part or all of these and other features and advantages of the present invention will become readily apparent to those skilled in this art from the following description wherein there is shown and described a preferred embodiment of this invention, simply by way of illustration of one of the modes best suited to carry out the invention. As it will be realized, the invention is capable of different embodiments, and its several details are capable of modifications in various, obvious aspects all without departing from the invention. Accordingly, the drawings and descriptions will be regarded as illustrative in nature and not as restrictive.

DETAILED DESCRIPTION OF THE PREFERRED EMBODIMENTS

The detailed technology description is accompanied by the embodiments and figures.

Figure 1:
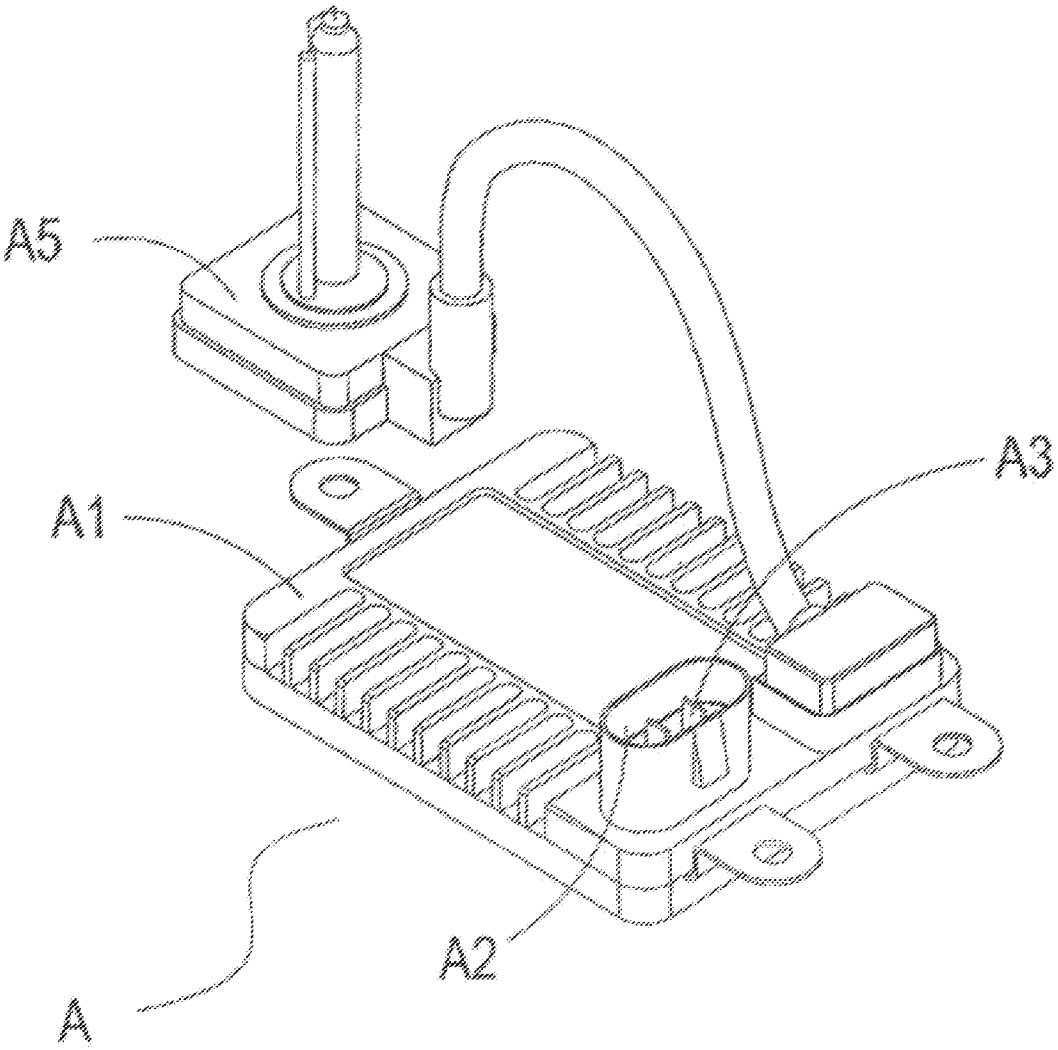
FIG. 1 (Prior Art)
FIG. 1 illustrates an isometric view of a prior art.
Figure 2:
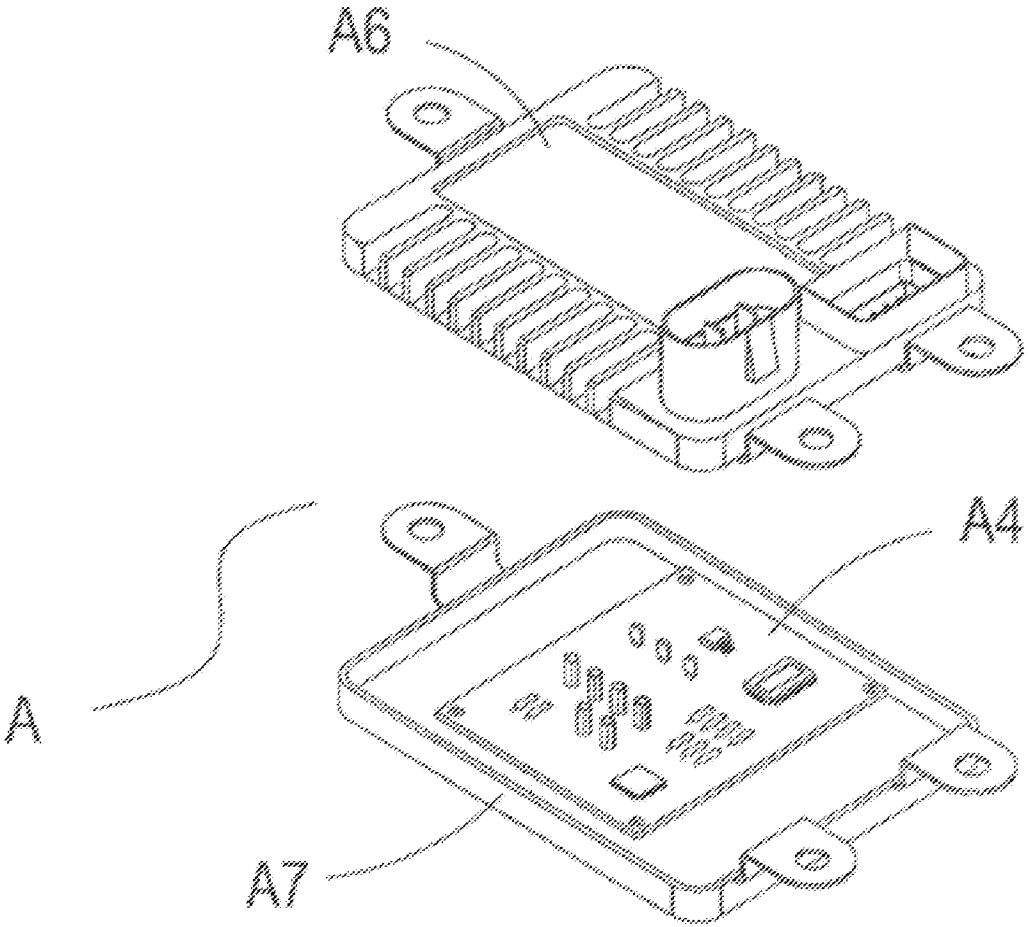
FIG. 2 (Prior Art)
FIG. 2 illustrates one embodiment of the prior art.
Figure 3:
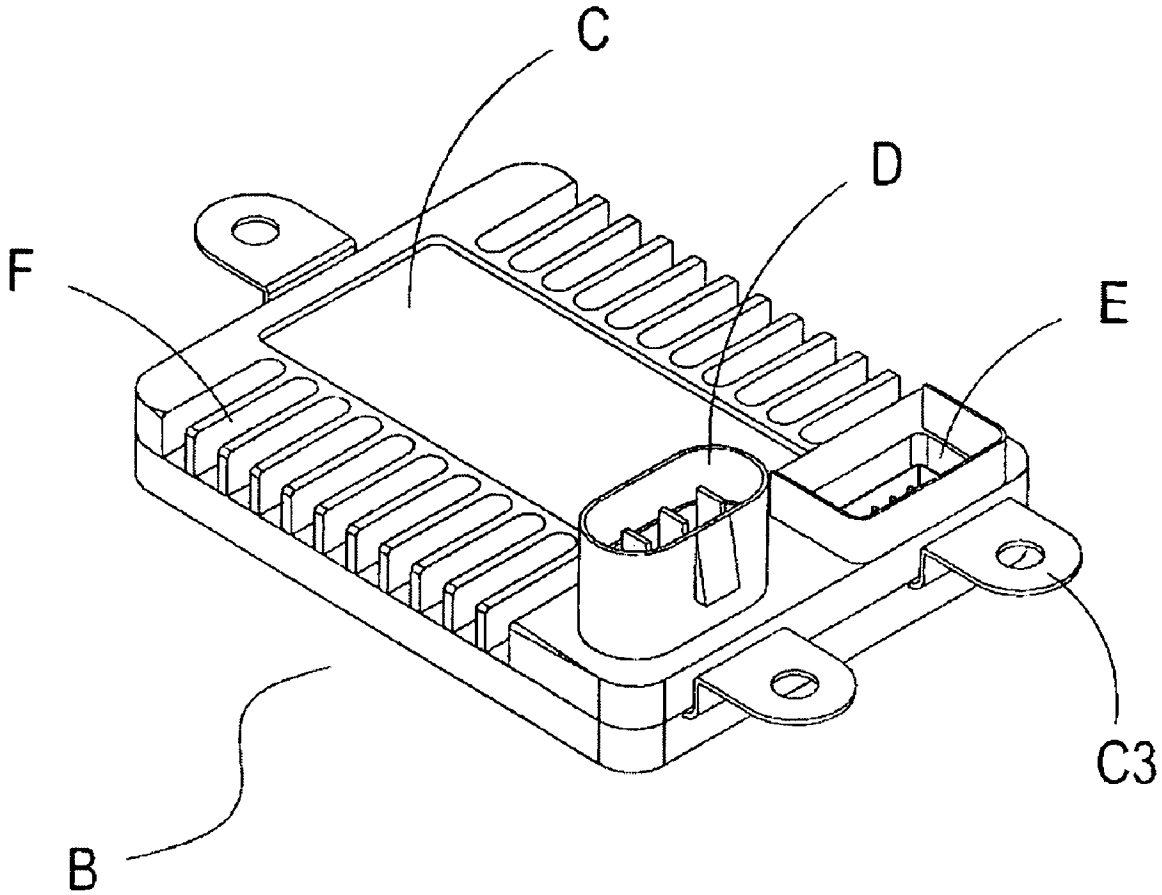
FIG. 3 illustrates an isometric view of one embodiment of the present invention.
Figure 4:
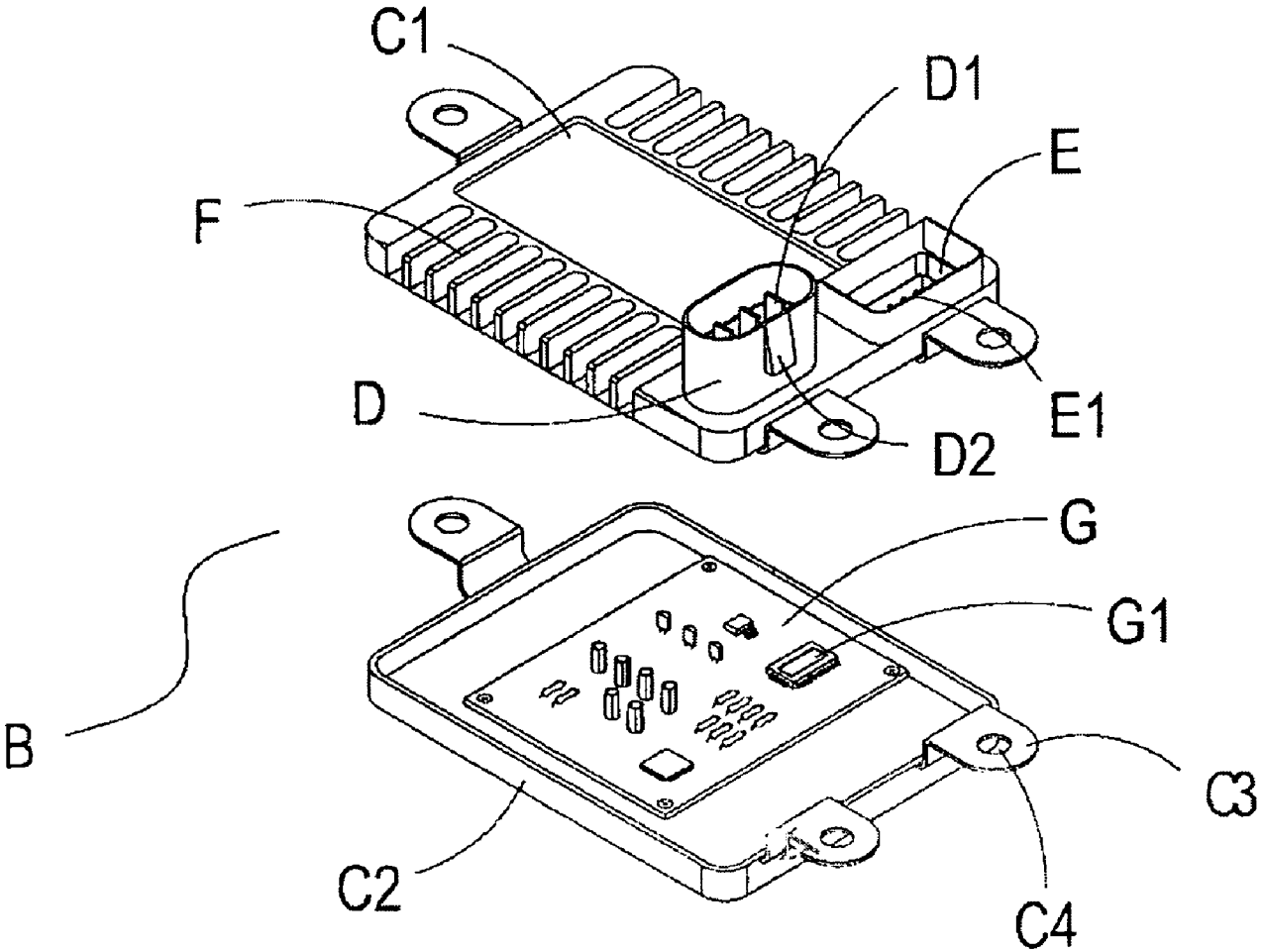
FIG. 4 is a partially exploded view of one embodiment of the present invention.

Please referring to FIG. 3 and FIG. 4, a stabilizer B with brightness control for a High Intensity discharge lamp according to one embodiment of the present invention is illustrated. The stabilizer B comprises a base C, a ribbing cooler F, a circuit board G, an output E and a power input D.

The base C further comprises an upper base C1 and a lower base C2, wherein a ribbing cooler is arranged at one side of the upper base C1 and an output E and a power input D is arranged at the other side of the upper base C1. A connect pin E1 is configured in the output E and a triple connect pin 01 is configured in the power input D. In addition, a hook portion is formed at the side of the power input and a fixating section C3 with an opening C4 is formed at the side of the lower base C2. The circuit board G is configured inside the lower base C2, in which a control element G1 is configured for the use of watts-switching (adjusting).

One of the features of the present invention is that the power input could comprises a connect terminal D1 having at least three terminals, wherein one of the three terminals is a positive electrode terminal, another one is a negative electrode terminal and the rest one is a power-switching terminal. The power-switching terminal is capable of adjusting power consumption (watts) by controlling the connection between the power input and the negative electrode terminal.

Quantities of the ribbing cooler could be one or more, which is used to cool down the stabilizer B so that a device configured with the ribbing cooler F would not over heat so as to bum down the stabilizer B.

Figure 5:
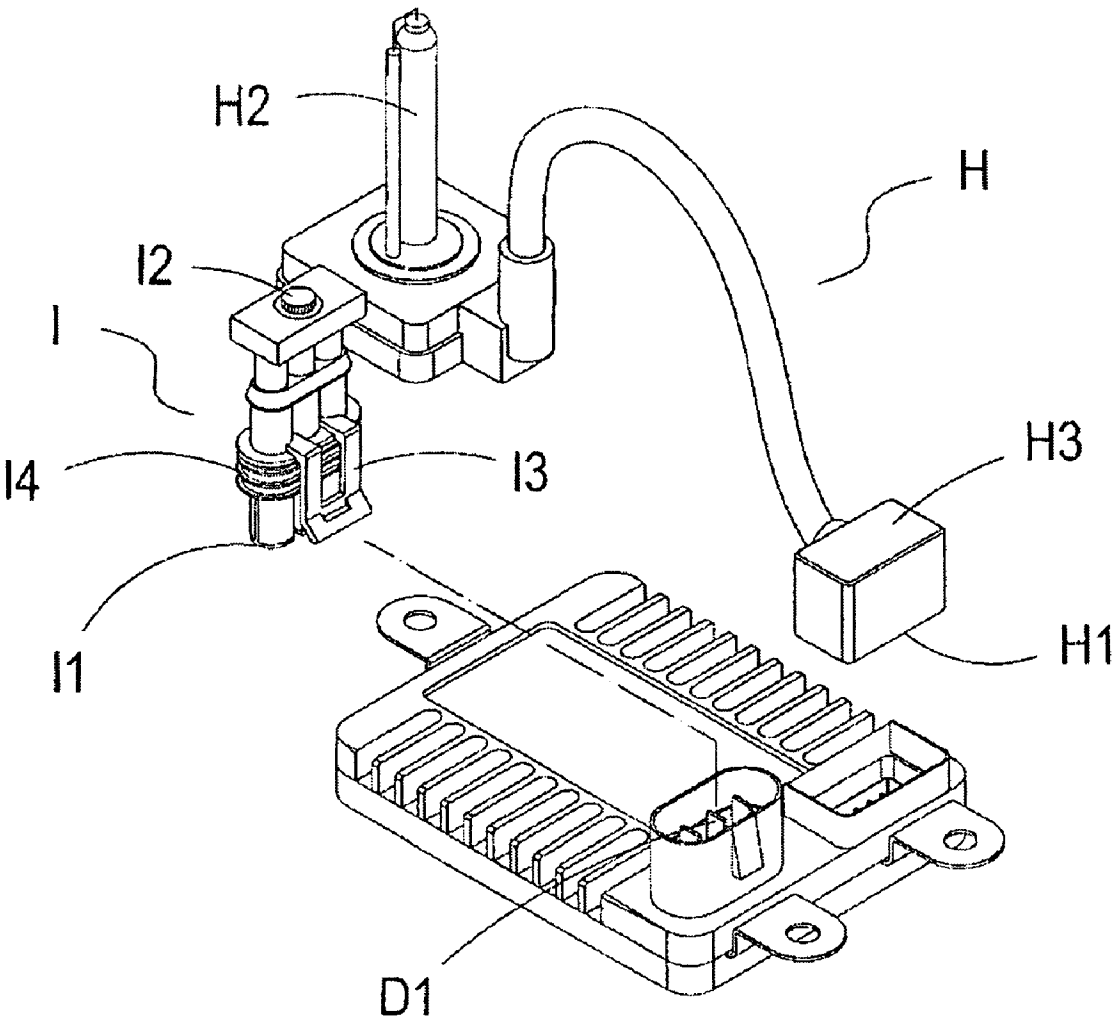
FIG. 5 illustrates an isometric view of one embodiment of the present invention.
Figure 6:
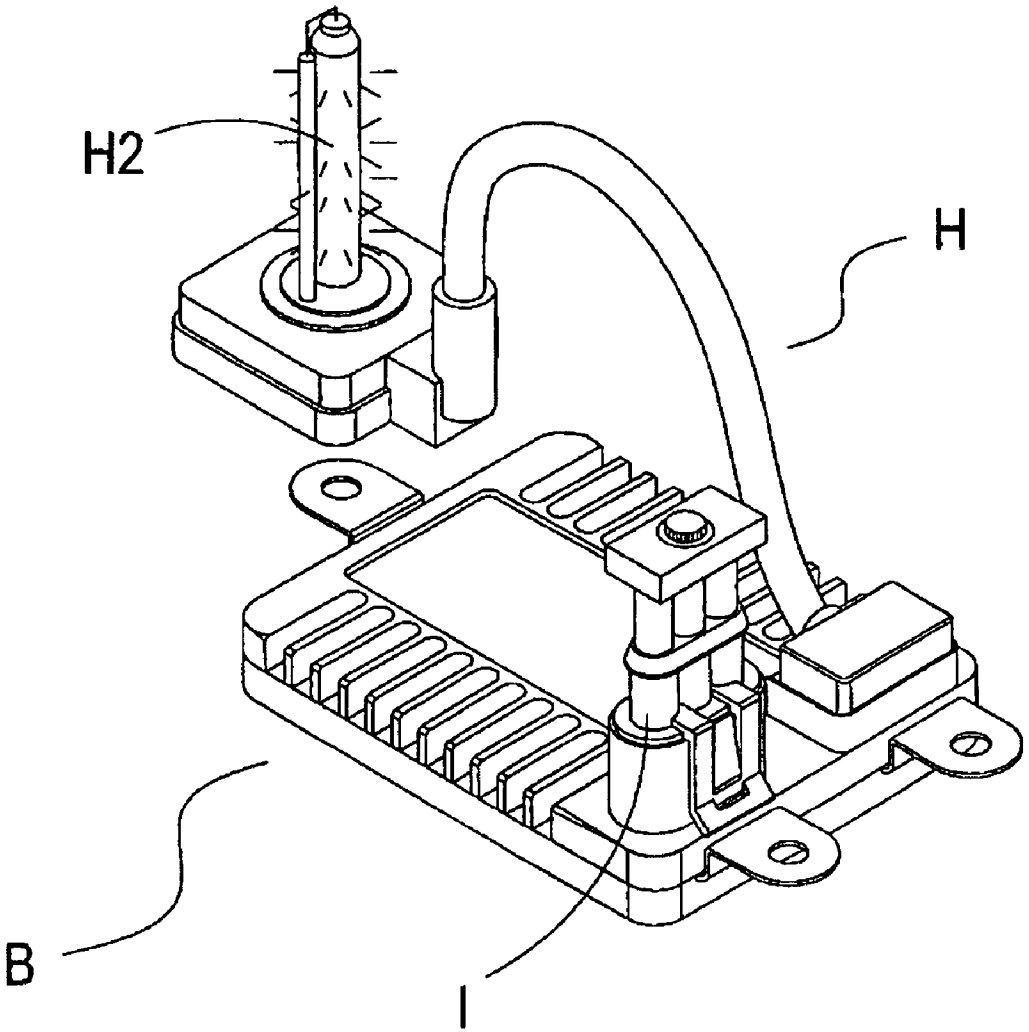
FIG. 6 illustrates an isometric view of second embodiment of the present invention.

A stabilizer B with brightness control for a High Intensity discharge lamp according to one embodiment of the present invention is illustrated in FIG. 4, FIG. 5 and FIG. 6. The HID (High Intensity Discharge) H2 is lightened by a predefined power (watts) settled by a circuit board G. A control unit G1 on the circuit board G is used for adjusting consumption power. Under above arrangement, a control switch 12 could correspond with the control unit G1 on the circuit board to implement power consumption control (watts) function at will.

The connect terminal D1 configured with the power terminal D on a base C has at least three terminals, wherein one of the three terminals is a positive electrode terminal, another one is a negative electrode terminal and the rest one is a power-switching terminal. The three terminals of the control switch 12 is coupled with the positive electrode terminal, the negative electrode terminal and the power-switching terminal respectively through the switch I and further extend to the control unit G1 of the circuit board G from the power-switching terminal so as to adjust the power consumed by the HID H2.

At least one pins E1 is configured with a output terminal E on the base C and the output terminal E is corresponding to a plugging portion on a connecting device H wherein one end of the connecting device H is extended to couple with a HID H2 and the other side of the connecting device H is coupled with a plug H3. The plug H3 is configured with a plurality of plugging portion H1 corresponding to the pins E1.

One side of the switch I is configured with a connection portion I1 corresponding to the power input D and the other side of the switch I is configured with a control switch I2. One side of the switch I is formed as a hook I3, which is used for coupled with the hook D2 of the power input D, and hitched with a ring I4, wherein the ring I4 is used for waterproofing.

For highlighting utility and non-obviousness of present invention, an analysis among the present invention and the conventional arts is disclosed as follow:

The disadvantages in conventional arts:

1. One HID stabilizer provides a fixed quantity of power (watts) only so that it must be replaced when a HID is detached and causes an additional cost.
2. As mentioned above, it wastes a lot of resources and does not comply with conceptions of environmental protection.

The advantages of the present invention:

1. The power consumption of the HID could be adjusted corresponding to the control element through the control switch.
2. As mentioned above, the applications of the present invention are convenient.
3. The applications of the present invention could reduce cost and be valuable in environment protection.
4. Embodiments of the present invention comply with examination under utility and obviousness.

Abilities for Industrial competition are developed under the present invention. Although the invention has been described and illustrated with reference to specific illustrative embodiments thereof, it is not intended that the invention be limited to those illustrative embodiments. Those skilled in the art will recognize that variations and modifications can be made without departing from the spirit of the invention. It is therefore intended to include within the invention all such variations and modifications which fall within the scope of the appended claims and equivalents thereof.

One skilled in the art will understand that the embodiment of the present invention as shown in the drawings and described above is exemplary only and not intended to be limiting.

The foregoing description of the preferred embodiment of the present invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A stabilizer with brightness control for a High Intensity discharge lamp comprising:

a base having a fixating section, wherein a circuit board is configured inside;

a ribbing cooler configured in one side of the base;

a socket configured in the other side of the base corresponding to a HID; and a power input having a positive electrode terminal, a negative electrode terminal and a power-switching terminal configured in the same side with the socket, wherein a control unit of the circuit board is controlled by one of the connection terminals connected with the power input and the power-switching terminal is controlled by the control unit connecting to the negative electrode terminal through a control switch so as to adjust power consumption (watts) of the HID at will.

2. As cited in claim 1, wherein the terminals of the power input is corresponding to at least three plugs of a switch.

3. As cited in claim 1, the ribbing cooler is used to cool down the stabilizer.

4. As cited in claim 1, the stabilizer is fixed with a board by an opening in the fixating section.

* * * * *